US005829364A

United States Patent [19]

Urbach

[11] Patent Number: 5,829,364

[45] Date of Patent: Nov. 3, 1998

[54] TRANSPORT AND STORAGE SYSTEM

[75] Inventor: Dieter Urbach, Grünwald, Germany

[73] Assignee: Oeco-Team Unternehemens- und Umweltberatung GmbH, Germany

[21] Appl. No.: 491,964

[22] PCT Filed: Nov. 23, 1994

[86] PCT No.: PCT/EP94/03877

§ 371 Date: Jul. 1, 1996

§ 102(e) Date: Jul. 1, 1996

[87] PCT Pub. No.: WO95/14616

PCT Pub. Date: Jun. 1, 1995

[30] Foreign Application Priority Data

Nov. 23, 1993 [DE] Germany ..... 93 17 917 U

[51] Int. Cl.[6] ..... B65D 19/12

[52] U.S. Cl. ..... 108/56.1; 108/51.1

[58] Field of Search ..... 108/56.1, 56.3, 108/51.1, 901, 902

[56] References Cited

U.S. PATENT DOCUMENTS

| | | | |
|---|---|---|---|
| 1,838,589 | 12/1931 | Stuebing, Jr. | 108/56.3 |
| 2,705,120 | 3/1955 | Owen | 108/56.1 X |
| 3,707,929 | 1/1973 | Lauffer | 108/901 X |
| 3,954,067 | 5/1976 | Miles . | |
| 5,417,167 | 5/1995 | Sadr | 108/902 X |

FOREIGN PATENT DOCUMENTS

| | | | |
|---|---|---|---|
| 732205 | 6/1955 | United Kingdom | 108/56.1 |
| 197806 | 6/1978 | United Kingdom | 108/56.3 |

*Primary Examiner*—Jose V. Chen

*Attorney, Agent, or Firm*—Fliesler, Dubb, Meyer & Lovejoy

[57] ABSTRACT

A transport and storage device comprised of individual, modular components connected to each other, preferably in the form of easily connected profile sections. The transport device may include a goods holding device forming the pallet deck, and a support device around the sides of the holding device, which support device includes a plurality of sections each including a base, a footing section extending upward from the base, and a supporting member mounted to the footing section for receiving and supporting the holding device. The sections of the support device may be provided with grooves, or drilled or punch openings, into which tongues, nuts or screws can be inserted, which are used to connect the components of the system according to the invention, thus insuring easy assembly, disassembly and interchangeability of the components of the transport and storage device.

10 Claims, 4 Drawing Sheets

TRANSPORT AND STORAGE SYSTEM

Figure 1:
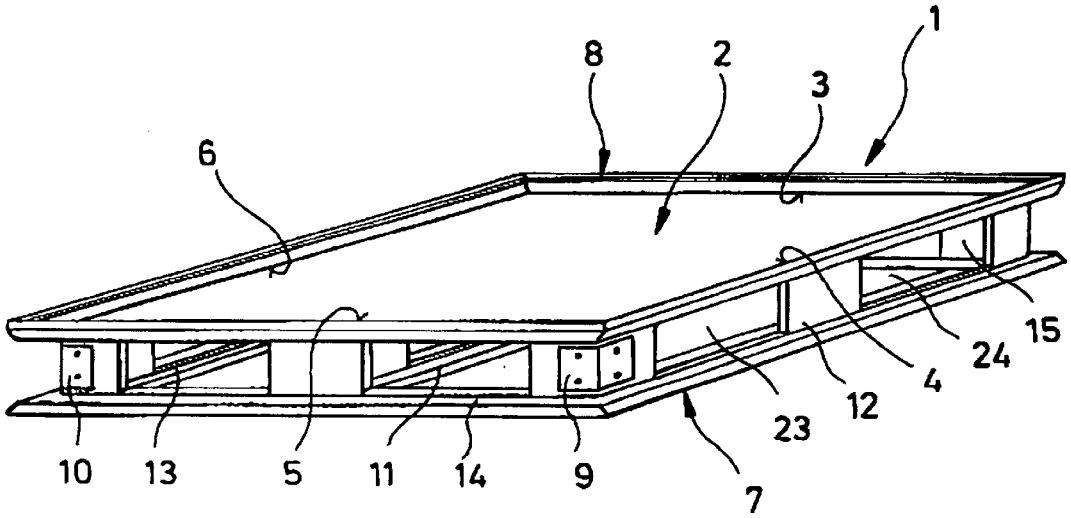

The invention pertains to a transport and storage system in accordance with the general terms mentioned in claim 1.

With the coming into force of the Packaging Law and international efforts to reduce, reuse and recycle packing and associated materials, the requirements made of transport and storage systems, for example pallets and containers or boxes, have changed drastically.

Industry and business now increasingly demand pallets and containers with a long life-span that can be reused for the user's purposes; moreover, the optimization of space, weight and material is being demanded. In addition, it should be possible to manufacture the pallets and containers in varying shapes and sizes to exact specifications of dimensions, weight and form, they should be easy to repair and clean, and be collapsible or foldable for return transport purposes.

A transport and storage system according to the general terms of claim 1 in the form of a flat pallet is known from DE-C-31 38 349. Transport and storage systems of this type are composed of extruded longitudinal and lateral supports, particularly of aluminum for applications in areas with high hygienic requirements. The longitudinal supports consist of three individual components that can be connected to each other. The upper component, which forms the supporting section, is equipped with a connecting device in the form of two shoulders which border an opening into which the lateral supports can be inserted.

A disadvantage of this type of transport and storage system lies in the fact that the packaged goods are not protected at the bottom, because the number of spaced lateral supports make it impossible to form a single loading surface. Because of these conditions, cavities are created in the longitudinal supports, since the lateral supports are inserted into the longitudinal supports at spaced distances.

In addition, it is necessary, in the case of transport and storage systems of this type, to provide openings for forklift trucks in the sidewalls of the longitudinal supports. These openings also create hollow areas which collect dust and dirt and are difficult or impossible to clean.

Similar problems occur in another system known from U.S. Pat. No. 3,954,067.

The object of this invention is, therefore, to create a transport and storage system of the type described in the general terms of claim 1, which can be manufactured economically and which specifically enables the requirements relating to hygiene, variability and stability to be met.

The means for attaining the object of the invention is provided by the characteristics of claim 1.

The transport and storage system in accordance with the invention, which advantageously allows for a modular constructed unitary design making use of light metal alloy profile sections, meets the requirements of industry and businesses as detailed above and even exceeds these in part. Height, length, width, configuration and carrying capacity of the transport and storage system can be adapted to individual requirements as desired.

Cleaning and repair can be done easily and economically, owing to the smooth and closed surfaces and to the problem-free collapsibility which can be carried out anytime.

The system in accordance with the invention is particularly suitable for air cargo and clean rooms, has a long lifespan and is easy to keep clean and repair when it is in use.

Moreover, there is an option of integrating additional expansions and modifications, such as hand holds, rollers, container or lattice box structures, eyebolts and similar items.

In the transport and storage system according to the invention, a pallet deck can be used initially as the goods holding device, consisting of two panels connected by a connecting profile section and which is open at its outer edges. In this embodiment, the clamping and sealing channel of the connecting device takes over the clamping and sealing function, because the open outer edges are covered all around. Simultaneously, this of course results in the creation of a protective edge.

As an alternative to this, it is possible to use a solid panel, i.e. a component that is not hollow, for the pallet deck, which also can be inserted into the clamping and sealing channel. In the case of a solid panel, the edge protection provided by the clamping and sealing channel in accordance with the invention stands out primarily, in addition to the clamping function. If, however, for example, a wooden panel, preferably a plywood panel, is used, then the sealing function is also significant, because the clamping and sealing channel in this case prevents moisture absorption through the unprotected outer edges owing to the all-round covering of the edges.

Basically, the above-mentioned types of goods holding devices can be manufactured of practically any suitable material. The preferred materials to be used are, however, metal, particularly aluminum, as well as plastic or wood.

The dependent claims contain advantageous refinements of the invention.

To create a modular constructed, easily assembled and disassembled transport and storage system in accordance with this invention that meets the requirements stated in the preamble, it is possible to design the support device as individual components connected to each other, preferably in the form of easily connected profile sections. The footing sections in particular can be constructed as bar sections which can be extruded or cast.

Particular preference for the material is given to metal in the form of a light metal alloy, particularly aluminum.

The sections can be provided with grooves, drilled or punched openings, into which tongues, nuts or screws can be inserted which are used to connect the components of the system according to the invention, thus ensuring easy assembly and disassembly. If corner connections are required to form the clamping and sealing channel extending around all the edges of the goods holding device, these can be provided by gusset plates, angle sections, plug connection designs, detent designs, brackets, rivets, threaded connections or welded connections, if necessary.

Should, in a specific instance, arrangements be required to seal open ends, for example of footing or skid profile sections which are open at one end, then can these be made by inserting end plates.

In principle, it is possible to provide the transport and storage system according to the invention with a support device designed as one piece, which in a specially preferred embodiment consists of a skid base section, a support footing section and a support section. In a particularly advantageous embodiment this results in a double T-beam, on top of which, in the assembled state, the connecting device which forms the clamping and sealing channel is fitted.

The other basic possible embodiment is a modular constructed support device which can be installed and removed, which consists of at least one footing section and a supporting member having the clamping and sealing channel. In this embodiment, as an option, a profile section can be attached to the footing section as the skid base part.

Both of the embodiments described above can be provided, as further development stages, with plug-in channels fitted on the clamping and sealing channel and which allow the erection of containers in the form of crates or boxes, wherein vertical panels are inserted into the plug-in channels.

As connection devices for the individual components of the transport and storage system in accordance with the invention, consideration is given in principle to screw, clasp, plug and clamp connections if disassembly is desired. If there is no such requirement, then welded, adhesive and rivetted connections are also possible.

All embodiments of the transport and storage system in accordance with the invention can furthermore be provided with supplementary equipment, for example in the form of hinge grooves. Such hinge grooves are, in practice, provided near the supporting member, preferably as a part of the connecting device, and permit the attachment for example of handles, hinged panel sections and the like.

In a particularly advantageous embodiment, the transport and storage system in accordance with the invention is designed as a folding container or a collapsible bin. The especially advantageous embodiment uses the system known as M-folding. This, first of all, consists of a base plate which, in accordance with the principles of the invention, is provided with a goods storage device, for example with a panel-like pallet deck, whose connecting device has a clamping and sealing channel extending around all the edges of the goods holding device. This base unit is provided with a raised edge along its outer edges, which outlines a holding area on the pallet deck, whose height permits the folding of the container walls, so that it can be fully folded inside the holding area. On one of the long sides of this raised edge a hinge is fitted, to which a longitudinal panel, for example the rear wall of the container, is attached so that it can fold. On the two short sides of this rear wall, divided side walls are attached by hinges and these side walls, in turn, are connected in their centres to each other by hinges. At the end of both side walls which are facing away from the rear wall, a front wall is attached parallel to the rear wall by hinges on its short sides. Finally, a cover section is attached to the remaining free long side of the rear wall in such a way that it can move 270°. The edges of the side walls and the front wall which are facing away from the pallet deck are provided with a ridge of smaller size than the wall thickness, which engages corresponding grooves in the side walls and the front wall when these are placed on the raised edges of the pallet deck to form the container. In this unfolded state, the cover section can be pivoted by 270° from its opened position, in which it is flat against the rear wall, to its closed position, in which it also engages the upper ridges of the side walls and the front wall with a groove extended on three sides, so that preferably a dustproof and, in a suitable embodiment, logically also a waterproof, sealing of the interior of the container is possible.

In this design it is especially preferably possible for all the walls and the cover to be constituted by a connecting device of profile sections, in whose clamping and sealing channels panels can be inserted, so that the components which are similar, that is, the front and rear wall and the side walls can be constructed identically. The cover section consists of a profile which is identical at the top and bottom on three edges, so that when the walls are erected, it covers the interior of the container with one side. On the other hand, in the folded state, that is, when front, side and rear walls are folded inside the space formed by the raised edges of the base unit, the other side of the cover covers the container which has been collapsed into itself The side of the cover facing away from the container at the same time forms a stacking and locking edge with its upwards profile section design.

Further details, characteristics and advantages of the invention result from the following description of exemplary embodiments based on the drawing.

Figure 2:
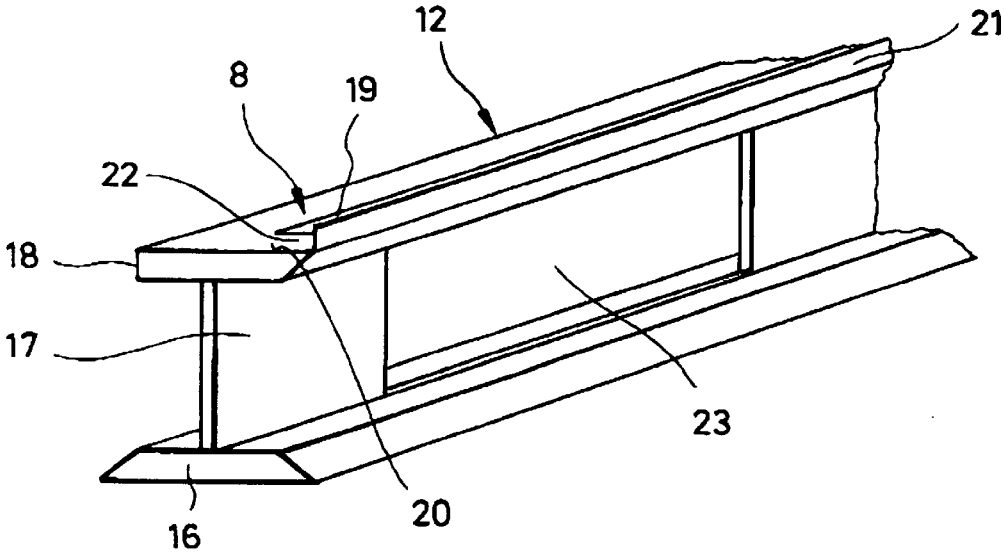
Figure 3:
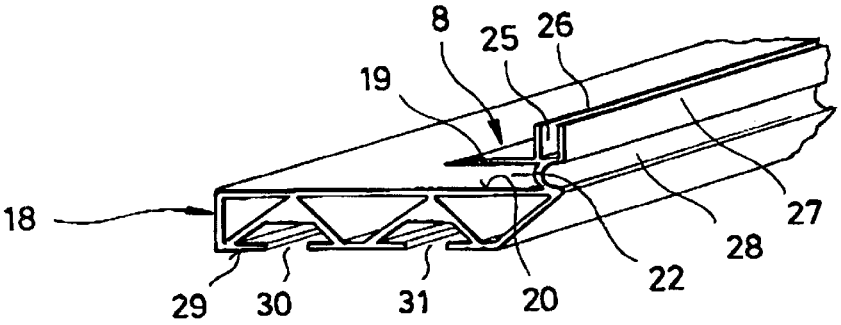
Figure 4:
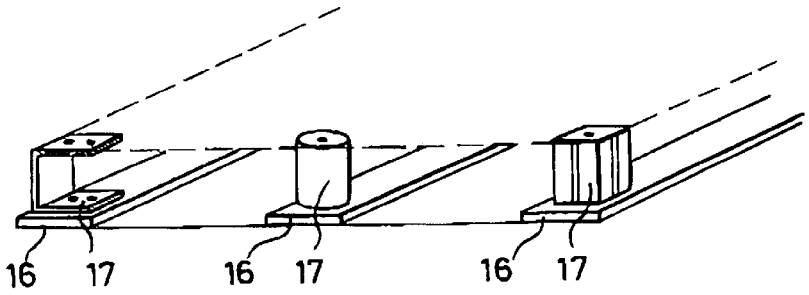
Figure 5:
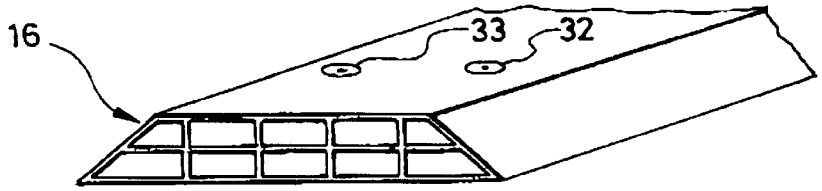
Figure 6:
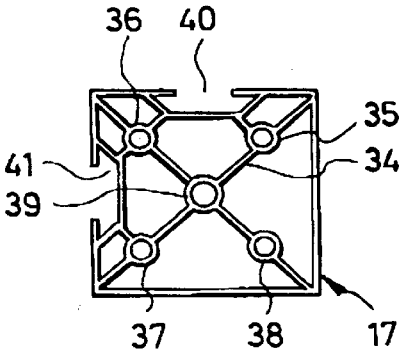
Figure 7A:
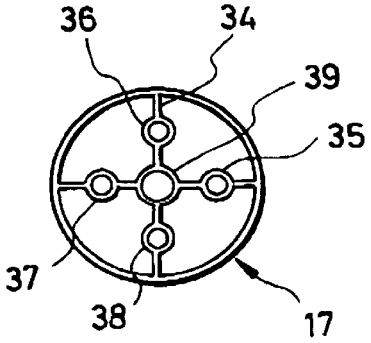
Figure 8:
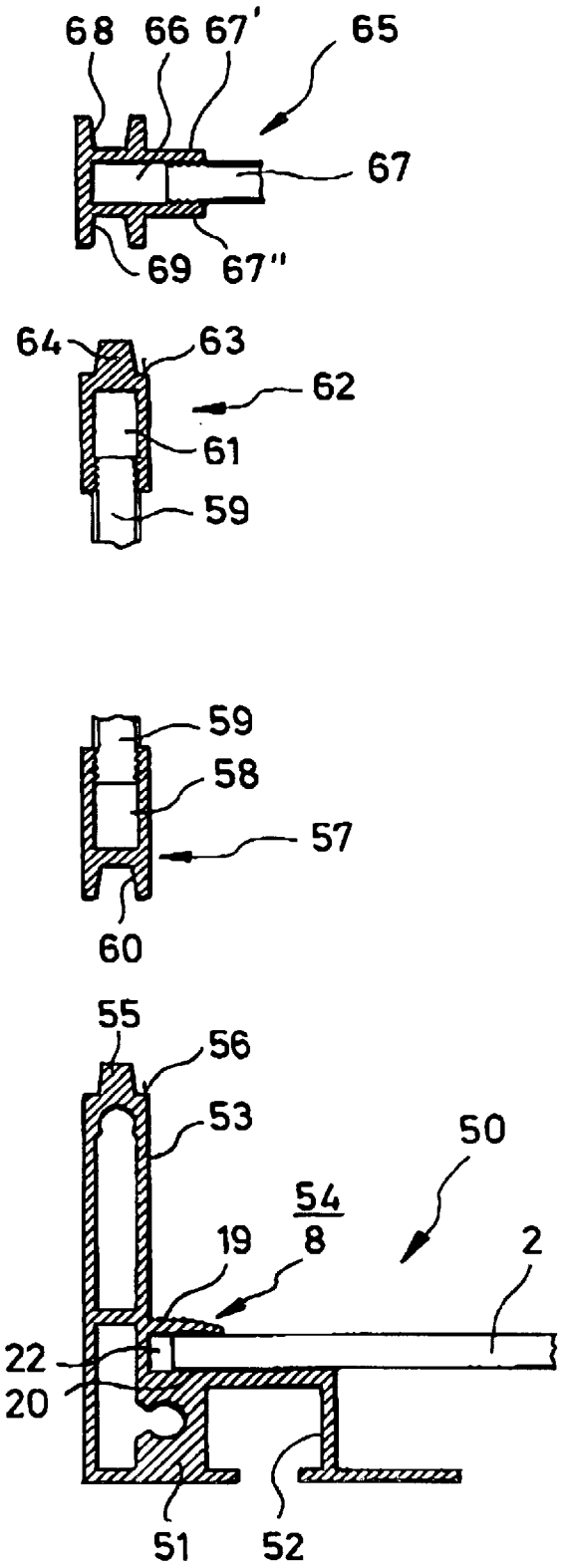
Figure 9A:
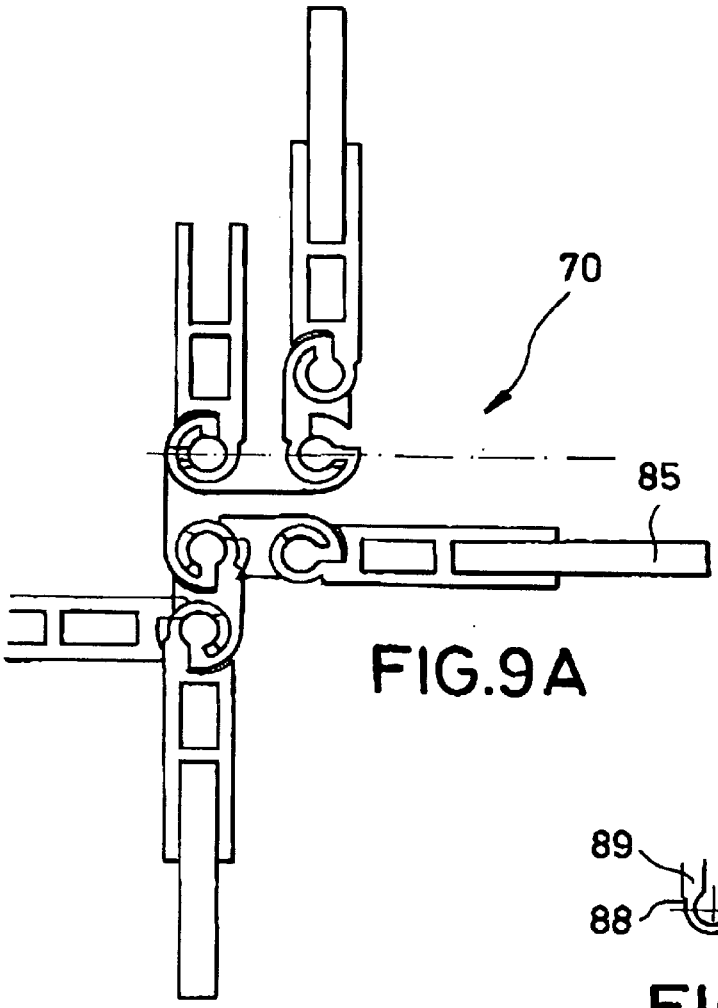

These show the following:

FIG. 1 a schematically slightly simplified perspective representation of an embodiment of a transport and storage system in accordance with the invention;

FIG. 2 a representation of an embodiment of a component of the support device of the transport and storage system according to FIG. 1 corresponding to the illustration in FIG. 1;

FIGS. 3 to 5 perspective illustrations corresponding to FIGS. 1 and 2 of a second embodiment of the support device of a transport and storage system;

FIGS. 6 and 7A, B cross-sections of footings of the support device of the transport and storage system in accordance with the invention;

FIG. 8 an exploded view of components of the transport and storage system in accordance with the invention according to a second preferred embodiment;

FIGS. 9A, B, C a representation of a hinge system in accordance with the invention which can be handled as an individual item, particularly for a transport and storage system in accordance with the invention.

FIG. 1 illustrates a transport and storage system 1 in accordance with the invention in a schematically simplified representation. The transport and storage system 1 is in this example constructed as a flat pallet and is designated as such hereafter:

The flat pallet 1 has a goods holding device 2 which in the case of the example forms the pallet deck. The pallet deck of the goods holding device 2 has two panels not detailed in FIG. 1, which are connected via a connecting member (e.g. in the shape of a corrugated profile section) which is also not detailed further. In an especially advantageous embodiment, the pallet deck of the goods holding device 2 is manufactured from aluminum and is constructed in the above-described manner similar to corrugated cardboard.

These pallet decks are open along the four leading edges 3 to 6. In principle, however, the invention also includes another pallet deck embodiment, both in its construction and its selection of material. Particular advantages are obtained in both cases by the use of a light metal alloy, particularly in the form of aluminum.

The transport and storage system 1 in accordance with the invention as represented by the flat pallet illustrated in FIG. 1, furthermore has a support device 7 which, in the example, consists of four support members arranged around the leading edges 3 to 6. One of these support members is illustrated in FIG. 2. The support device 7 again is provided with a connecting device 8 to lock the goods holding device 2. FIG. 1 illustrates here that the connecting device 8 extends around all edges 3 to 6 of the goods holding device 2. In this way, it is possible to lock the goods holding device 2 by connecting device 8, as well as to close its open edges 3 to 6.

In addition, FIG. 1 illustrates that the four individual components of support device 7 which are arranged around the edges 3 to 6 of goods holding device 2, are connected by corner modules so as to form a continuous frame, whereby modules 9 and 10 of the corner modules are visible owing to the method of illustration selected. Lastly, in the particularly advantageous embodiment illustrated in FIG. 1, support device 7 has a fifth support member 11 which is arranged between the outer support members 12 and 13 and is connected to support members 14 and 15 in a manner not illustrated here.

Because all the support members are designed in the same manner and way, the design of support device 7 being one of these support members is described below as representative for all using FIG. 2.

In the embodiment illustrated in FIG. 2, support member 12 is depicted as being of one-piece construction. In the example, it has a longitudinal skid base 16, a footing section 17 which is arranged perpendicular to the skid base 16 and a supporting member 18 which again is at a right angle to the footing section 17. The skid base 16 may be equipped with channels into which the connecting or covering components or also anti-skid devices can be inserted. The footing section 17 forms a supporting footing for support device 7, which by its attachment to supporting member 18 has connecting device 8 at its top. FIG. 2 illustrates that connecting device 8 is formed by two spaced shoulders 19 and 20. In this case, the shoulder 20 is an integral part of supporting member 18. Because of the connection between supporting member 18 and connecting device 8, this is again connected with skid base 16, thus resulting in an integrated design. The shoulder 19 is here connected to supporting member 18 via a perpendicular ridge 29. As clarified in FIG. 2, ridge 21 projects slightly beyond the horizontal surface of the shoulders 19 and thus forms an edge rail during assembly as depicted in FIG. 1, which prevents a skidding of the goods arranged on the goods holding device 2.

Shoulders 19 and 20 form, as shown in FIG. 2, a clamping and sealing channel 22. This clamping and sealing channel 22 includes the outer areas of goods holding device 2, as can be seen in FIG. 1. Thus, while inserting the goods holding device 2 into the clamping and sealing channel 22 in the assembly position, both a locking as well as a sealing of the open edges 3 to 6 of goods holding device 2 is achieved.

To assemble the flat pallet I illustrated as an example in FIG. 1, first of all three of the support members of support device 7 are connected using the corner modules 9 and 10. Next the goods holding device 2 is inserted into the clamping and sealing channel 22 now formed along the edges. In order to be able to close the remaining fourth open edge, a fourth support member is connected to two of the previously connected support members, thus creating an all-around frame which can be seen in FIG. 1, which forms the support device 7 and locks, stabilizes as well as seals the open edges of the goods holding device 2. In order to prevent [TR: sic] undesirable vibration, especially of the unloaded goods holding device 2, it is possible to choose a slightly conical shape for the cross-section of the clamping and sealing channel 22, so that the clamping effect is enhanced. Furthermore, it is possible, to fit additional seals into clamping and sealing channel 22, for example in the form of sprayed-on silicon paste, or inserted sealing and vibration elements. Such sealing and vibration elements can, for example, be in the form of U-shaped rubber rings, which surround the edges of goods holding device 2 and can be inserted into clamping and sealing channel 22.

In order to make it possible to manipulate a flat pallet 1 in accordance with FIGS. 1 and 2 using manual handling equipment, the support members are also equipped with openings of which in FIGS. 1 and 2, openings 23 and 24 have been given representative reference numbers.

FIGS. 3 to 5 illustrate an alternative embodiment of support device 7 of the transport and storage system 1 in accordance with the invention. This embodiment allows for a modular construction of the transport and storage system 1, because support device 7 is not designed as a one-piece profile section, but has been broken down into its components. Because these, however, have essentially the same function as in the embodiment in FIG. 1, the similar components have been given the same reference numbers below as have been used in FIGS. 1 and 2.

Accordingly, FIG. 3 illustrates a supporting member 18 formed by a profile section, which also has a connecting device 8 with shoulders 19 and 20. The shoulders 19 and 20 again form a clamping and sealing channel 22, so that this far, reference may be made to the embodiment in FIG. 2.

In this embodiment the connecting device 8 is fitted with a plug-in channel 25 on top of shoulder 19. Plug-in channel 25 is defined by two flanges 26 and 27 which are connected to the outer edge of shoulder 19 in one piece. A fillet 28 is next to plug-in channel 25 which is open to the outside and forms a hinge groove. Fillet 28 also forms a single piece with shoulder 19 and supporting member 18.

In addition, FIG. 3 illustrates that supporting member 18 is equipped with profile recesses 30 and 31 on its bottom 29. The profile recesses 30 and 31 serve to accommodate the threaded rods of tongues which can be inserted into the profile of the supporting member 18. Such tongues can be used as connecting elements which connect the remaining components of the support device 7 that are still to be described together.

The plug-in channel 25 of supporting member 18 in accordance with FIG. 3 is able to accommodate straight or vertical wall elements, so that it is possible to assemble containers with vertical walls, in addition to the flat pallet shown in FIG. 1 as an example.

Handles or movable wall components fitted with a suitable adapter can be inserted into hinge groove 28.

FIG. 4 illustrates examples of three possible embodiments of support footing section 17, which can be connected to supporting member 18 as illustrated in FIG. 3. As can be seen in FIG. 4, particular advantageous embodiments are angles (right angled, rectangular), cylindrical or U-shaped embodiments. FIG. 4 indicates that the footing sections 17 can not only be connected to the supporting member 18, but also to a skid base which is similar to the skid base illustrated in FIG. 2. In the embodiment according to FIGS. 3 to 5, this skid base 16 does not, however, form a single piece with footing section 17, but can be installed and removed like the supporting member 18. A possible embodiment for the skid base is shown in FIG. 5 and is described below representatively for the skid base 16 illustrated in FIG. 4. FIG. 5 illustrates here that the skid base 16 can also be constructed as a profile section. In the example shown it has a trapezoidal cross-section. Skid base 16 is connected to recesses, of which in a representative manner recesses 32 and 33 are indicated. These recesses, the number of which corresponds to the number of connection locations, can serve for example to pass through the connecting bolts which pass through skid base 16 and the footing section 17 and can be threaded to the previously mentioned threaded rods of a key which has been inserted into the profile of supporting member 18.

FIGS. 6 and 7A and B again show examples of possible embodiments of the footing section 17. Accordingly, in an embodiment in accordance with FIG. 6, an angled support footing cross-section is provided. Support footing section 17 is also designed as a profile section and has an internal cross-shaped web design 34. In the corner areas of this web design are four mounting recesses 35 to 38 shaped as sleeves. These can accept and guide the shafts of the afore-mentioned connection bolts. In the particularly advantageous embodiment illustrated in FIG. 6, a further sleeve 39 is provided in the centre. The design in accordance with FIG. 6 moreover has two tongue slots 40 and 41 open at the outside edge.

Figure 7B:
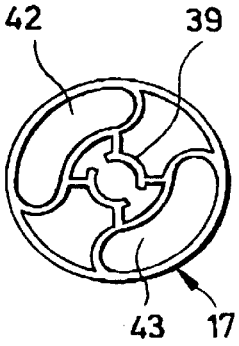

The embodiment of the support footing in accordance with FIG. 7A differs from the embodiment according to FIG. 6 first of all by its cross-section. Otherwise, the embodiment according to FIG. 7A is also a profile section equipped with a cross-shaped web design 34 and four sleeves 35 to 38. In the centre is a further sleeve 39. Another alternative embodiment of a support footing is shown in FIG. 7B, which also has a centre sleeve 39, similar to sleeve 39 in the embodiment according to FIG. 7A. In contrast to the embodiment of FIG. 7A, the support footing 17 of FIG. 7B has two oblong holes 42 and 43 situated opposite each other. The oblong holes 42 and 43 take the place of recesses 35 to 38 of the embodiment in accordance with FIG. 6 and FIG. 7A. However, these allow for the accommodation of mounting devices, in case the bevel angles are other than 90°. The oblong holes 42 and 43 are radially reinforced and thus offer possibilities for passing through bolts to reinforce and connect regularly and irregularly shaped polygonal panels.

The arrangement of sleeves 35 to 38 at 90° intervals as shown by cross-shaped web 34 makes it possible to connect the bevel angles formed by the connecting profile sections of the individual components in accordance with FIGS. 3 to 5, without any requirement for additional devices. Thus, it is also possible with the modular design of the support device according to FIGS. 3 to 5 to form a clamping and sealing channel 22 extending around all the edges, as has been described on the basis of the embodiment in accordance with FIGS. 1 and 2. In the embodiment in accordance with FIGS. 3 to 5 there are particular advantages, because the support device 7 constructed in this manner and thus the correspondingly constructed transport and storage system 1 can be completely assembled and disassembled, which results in the special advantages set out in the preamble.

As has been explained before, using FIG. 1 only a flat pallet was used as an example. With the transport and storage system 1 in accordance to the invention, it is, however, possible to design the goods holding device 2 as a flat, container, barrel, coil or lattice box pallet, as a crate or other container for loose cargo, bulk material or liquids.

Furthermore, the individual components of support device 7 detailed using FIGS. 3 to 7 are in principle also primarily suitable for manufacturing other designs in connection with panel-shaped components, such as for example partition walls or connecting walls for buildings or in automobile manufacture.

To clarify an embodiment of the transport and storage system in accordance with the invention in the form of a lattice box pallet, a container or a crate, reference will now be made to FIG. 8. FIG. 8 illustrates another embodiment of a supporting member 50 designed as a profile section, which has a connection device 8 corresponding to connecting device 8 of FIG. 3, and which includes two shoulders 19 and 20 to form a clamping and sealing channel 22. Profile section 50 is essentially an L-shape and includes a base 51 with a recess 52 which can be used to lock, support footings, skid bases or the like using bolts or tongues.

Furthermore, profile section 50 is distinguished by a edge rail 53 which is raised above the base 51. This edge rail 53 extends over the entire length of profile section 50 and serves, in the assembled state, to delineate a holding area 54 the sides of which are limited in the assembled state for example by the right-angled surrounding edge rail 53. This holding area 54 is used to accommodate collapsable or foldable front, rear and side walls of this embodiment of a transport and storage system in accordance with the invention in the form of a folding container. As can be seen in FIG. 8, these walls are placed in the folded state in the holding area 54, whose surface area is formed by the goods holding device 2, for example in the form of a panel-shaped flat pallet.

At the end of edge rail 53 facing away from the connection device 8, a ridge 55 is located which rises from the centre of the rear surface 56 of the edge rail 53. It should be added that, as clarified in FIG. 8, profile section 50 is designed as a hollow section, in order to make it possible to obtain a construction that is as light in weight as possible.

As illustrated in FIG. 8, a further profile section 57 connects to the upper end of edge rail 55 which is equipped with ridge 55; this section 57 has a clamping and sealing channel 58 into which a panel-shaped wall component 59 can be inserted. Opposite the end with channel 58, is a channel 60 which engages the ridge 55 when the container walls are straightened during unfolding. The engagement of ridge 55 in plug-in channel 60 allows the corresponding wall to be secured in the erected position. The partial illustration in FIG. 8 shows the top of profile section 57 with the upper connection of wall component 59, which in turn engages a clamping and sealing channel 61 of another profile section 62. This profile section 62 has a ridge 64 at its end 63 facing away from the clamping and sealing channel 61; the function of this ridge is similar to that of ridge 55 on profile section 59. Using this design, it is possible therefore to make up the front, side and rear walls of a container type transport and storage system which are all constructed identically.

As the final basic component, FIG. 8 shows a cover 65, which is also designed as a profile section. The cover 65 too has a clamping and sealing channel 66, into which a cover component, for example in the form of a profile section or a solid panel 67 is inserted. As FIG. 8 illustrates, cover 65 is symmetrical and has two opposing plug-in grooves or tongues 68 and 69 with openings in opposite directions. In the unfolded position, groove 69 engages ridge 64 and thus allows cover 65 to be secured in place. It is obvious that the grooves and ridges described above, extend over three sides of the container. The transport and storage system in accordance with the invention in the form of a container has for example, in the case of a cubic configuration, a right-angled basic component which consists of the goods holding device 2 and the profile section 50 which, in accordance with principles of the invention, surrounds the goods holding device 2 on its four sides, as is illustrated by way of example in FIG. 1. To make up a container-shaped transport and storage system, profile section 50 is to be provided with the edge rail 53 mentioned previously, which extends around all four sides and delineates the holding area 54 above goods holding device 2. On one of the four sides, for example, one of the long sides, a wall of the container to be formed is hinged to a hinging device, one end of which engages the edge rail 53 and the other the corresponding long side of the wall. Along the opposite end of this wall, a further hinging device is attached, by which the cover is movably attached to this wall. To the, in this example, remaining free short sides the divided sidewalls, which are connected to each other by hinges, are attached so they can move (in this case to the short sides). Finally, the free small sides of the side walls opposite to this hinged connection are connected by a hinging device to the front wall; in this case thus, the wall forming the second long side. To form the container, the walls placed in the holding area 5 by means of a so-called M-fold, are erected, whereby the front and side walls are straightened and aligned along the edge rail 53, so that the corresponding ridge 55 can engage the groove 60 which extends along the three sides. Subsequently, the cover can be flipped through 270°, so that it engages ridge 64 which extends along three sides, with its groove 69.

FIG. 9A illustrates an example of a hinging device 70 in accordance with the invention, with which, for example, the walls shown in FIG. 8 can be hinged together. Below, reference is made to FIGS. 9B and 9C in order to explain the principles of hinging device 70, during which the individual components of hinging device 70 will become apparent.

Figure 9C:
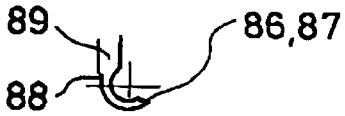
Figure 9B:
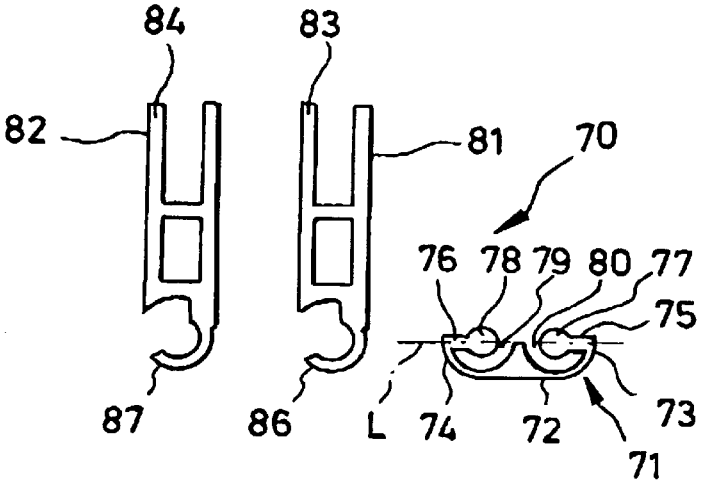

According to FIG. 9B, the hinging device 70 has a coupling element 71, which is shaped symmetrically. Coupling element 71 includes a carrier 72 whose 90° rounded ends 73 and 74 terminate in pins 75 and 76 lying along longitudinal axis L. Pins 75 and 76 facing each other are equipped with joint balls 77 and 78, which together with carrier 72 form two semi-circular guide slots 79 and 80.

FIG. 9B further illustrates two profile sections 81 and 82, which have at one of their open ends a clamping and sealing channel 83 or 84, into which wall components or goods holding devices in the form of pallet decks can be inserted, as can be seen in the example given in FIG. 9A using the example of wall component 85.

At the other end, profile sections 81 and 82 each have a guide tip 86 or 87, whose dimension and size is selected in such a way that they can engage the guide slots 79 or 80 of connecting element 71, as can be seen in the illustration in FIG. 9A.

FIG. 9C shows that the guide tip 86 or 87 leads from the adjacent wall section 89 via a topped section 88, thus making it possible to have a detent, as can be seen from FIG. 9A as well. The front face of guide tip 86 or 87 can also form a detent. Thus, with proper precision manufacture, a double detent can be created whose stability is increased even more. The hinge allows a movement of the walls through an angle of more than 90°, which for example can be advantageous when folding or erecting the container walls. That is because the ridges must be taken out of the grooves to do this, which usually requires a movement through an angle of approximately 105° to 110°. The detents prevent the maximum swing range from being exceeded. In addition, they indicate through the increasing resistance, that the required tilt position has been reached, which simplifies the folding or erection of the container walls.

I claim:

1. A transport and storage system (1), comprising:

a goods holding device (2), and a support device (7) having at least one support footing (17), and a connecting device (8) in the form of two spaced shoulders (19, 20) that constitute a clamping and sealing channel (22) for affixing the goods holding device (2), said clamping sealing channel extending along edges (3, 4, 5 and/or 6) of the goods holding device (2), said connecting device (8) being arranged on a supporting section (18), wherein said goods holding device (2) is modular constructed and capable of being designed as a flat, container, barrel, coil or lattice box pallet, as a crate or other container, and wherein said support device (7) is designed as a modular system of a plurality single components that can be assembled and disassembled, said system including said support section (18) being a profile member that is provided with profile recesses (30, 31) on its bottom (29), the profile recesses (30, 31) serving to accommodate connecting elements, and wherein said support footing (17) is adapted to constitute a system component that can be assembled and disassembled and that can be connected to said supporting section (18) selectively that means of said connecting elements for the purpose of which the support footing (17) is a profile member having receiving recesses (35 to 42) for receiving said connecting elements.

2. A transport and storage system according to claim 1, characterized in that the goods holding device (2) has a pallet deck consisting of two panels connected by a connecting profile section and which is open along all its outer edges (3 to 6).

3. A transport and storage system according to claim 1, characterized in that the footing section (17) and the supporting section (18) are of one-piece design.

4. A transport and storage system according to one of the claims 1 to 3, characterized in that it has a skid base (16) which can be connected to the footing section (16).

5. A transport and storage system according to claim 4, characterized in that footing section (17), supporting section (18) and the skid base (16) form a profile section (11 to 15) of one-piece design.

6. A transport and storage system according to claim 1, characterized in that support footing (17) and supporting section (18) are attached so that they can be detached, and that the skid base (16) is attached to the support footing (17) so that it can be removed.

7. A transport and storage system according to claim 1 or 6, characterized in that the support footing (17) has staggered pass-through openings (35 to 38 and 42, 43) extending through the support footing (17) from an upper surface of the support footing (17) to a lower surface of the support footing (17).

8. A transport and storage system according to claim 1, characterized in that the goods holding device (2) has a pallet deck in the form of a solid panel.

9. A transport and storage system according to one of the claims 1 to 3, 5 to 6, or 8, characterized in that the support device has a supporting section (50) consisting of a profile section, which at the edges nearest the clamping and sealing channel (22) has a raised edge rail (53) to delineate the edges of a holding area (54).

10. A transport and storage system according to claim 9, characterized in that it has a cover (75) consisting of a profile section with a clamping and sealing channel (66) and a cover panel (67), as well as groove (68, 69) extending along three sides of both opposite sides (67', 67").

* * * * *